United States Patent [19]

Phelps

[11] 4,298,634

[45] Nov. 3, 1981

[54] METHOD FOR COATING CYLINDRICAL SURFACES

[75] Inventor: Edwin H. Phelps, Birmingham, Ala.

[73] Assignee: Compagnie Internationale Pour l'Informatique CII-Honeywell Bull (Societe Anonyme), Paris, France

[21] Appl. No.: 204,049

[22] Filed: Nov. 4, 1980

[51] Int. Cl.[3] ..... B05D 1/12; B05D 7/22

[52] U.S. Cl. ..... 427/183; 264/270; 427/231; 427/232; 427/233; 427/234; 427/240; 427/355; 428/36

[58] Field of Search ..... 427/183, 231, 232, 233, 427/234, 240, 355; 118/DIG. 10, 55; 264/270; 428/36

[56] References Cited

U.S. PATENT DOCUMENTS 2,002,701 5/1935 McWane ..... 427/234
2,675,333 4/1954 Trout et al. ..... 427/234
2,730,463 1/1956 Phillips ..... 427/233

OTHER PUBLICATIONS

Robert Herman Bogue, *The Chemistry of Portland Cement*, Reinhold Publ. (1955).

*Primary Examiner*—Shrive P. Beck
*Attorney, Agent, or Firm*—Kerkam, Stowell, Kondracki & Clarke

[57] ABSTRACT

A method for coating the interior of a cylindrical surface comprising depositing on the interior or a rotating cylindrical surface a dry hydraulic cement composition and applying to the dry cement coating which is held stationary on the interior cylindrical surface by the centrifugal force of the rotating cylinder an aqueous composition and allowing the cement to harden to provide a coating having no tendency to slump or sag in the wet condition.

19 Claims, No Drawings

METHOD FOR COATING CYLINDRICAL SURFACES

DESCRIPTION

BACKGROUND OF THE INVENTION

The present invention relates to a method for forming a hydraulic cement coating on the interior surface of a hollow cylinder such as a pipe.

In the past, cement or similar coatings have been formed on the interior surfaces of metallic pipes by applying the wet cement composition to the interior surface and allowing it to set or harden. Due to the wet condition of the applied coating material, however, the lining has a tendency to slump or sag prior to hardening thereby resulting in non-uniform and inconsistent coatings. Moreover, coatings applied in this fashion have a tendency to crack when cured due to non-uniform contact of the cement coating with the interiorly curved surface to which it is applied and the tendency to slump, sag or pull away from the surface prior to hardening.

It has also been proposed to coat surfaces with cement according to the "Gunite" method. This method involves separately spraying the dry cement mix and water in such a manner that the particles of cement composition and droplets of water intermix in the space between the respective spray nozzles and the surface to be coated. The cement is thoroughly wetted before it reaches the surface where it is allowed to set and cure. Inasmuch, however, as the mixture which reaches the surface to be coated is wet it is difficult to control the uniformity and smoothness of the coating. Moreover, the Gunite method suffers from the disadvantage of "overcoating" whereby, due to "splashing" of the wetted mixture as it hits the surface, irregular peaks or mounds are formed in the coating.

For a description of the pneumatic or spray methods for coating surfaces with cement or mortar and the disadvantages associated therewith see "Concrete Technology and Practice", Taylor, pp 352–355 (Am. Elsevier Pub. Co., N.Y. 1972) and "ACI Manual of Concrete Inspection", pp 206–211 (Am. Concrete Institute Publication SP-2, Detroit, Mich., 1972). In the latter publication it is indicated at page 209 that the quality of the resultant coating is highly dependent upon the skill of the operator of the spray machinery and that constant inspection is required to ensure against incorporation of "rebound" concrete into the work.

It is an object of the present invention to provide a cement coating for the interior surfaces of hollow cylinders such as pipes which do not slump or sag and which have a greatly reduced tendency to crack after curing.

BRIEF SUMMARY OF THE INVENTION

The objects of the present invention are achieved by depositing on the internal surface of a hollow cylinder a composition comprising a substantially dry hydraulic cement, said cylinder being rotated about its longitudinal axis at a rate such that the centrifugal force generated thereby holds the cement composition substantially stationary at the point of deposition with respect to the said internal surface; applying to the said dry cement coated internal surface an aqueous composition containing an amount of water sufficient to substantially wet and harden said hydraulic cement, and continuing to rotate said cylinder until the said hydraulic cement coating has substantially hardened.

By rotating the cylinder at a rate sufficient to hold the dry cement composition stationary with respect to the internal cylindrical surface and spraying the dry coated surface with water, the entire coating composition is held substantially stationary thereby greatly reducing the tendency to slump or sag during the setting or hardening process. This enables the formation of a cement coating which has a greated reduced tendency to crack after the coating has cured or hardened.

DETAILED DESCRIPTION OF INVENTION

The method of the present invention enables the formation of hydraulic cement coatings on interior cylindrical surfaces without imposing rigorous controls on the amount of water utilized in the hardening process. In conventional operations wherein water is admixed with the hydraulic cement composition prior to coating, a "false set" or "flash set" occurs within a very short time. This "false set" would be highly advantageous in a cement-coating operation since it imparts a temporary green strength to the cement coating during the curing process. Inasmuch, however, as the "false set" occurs almost immediately after water addition to the hydraulic cement composition it is broken by the long mixing times required in conventional operations to achieve a homogeneous admixture. Obviously, therefore, the "false set" cannot be relied upon to hold the wet coating in place during the curing process to avoid sagging or slumping.

In the method according to the present invention, the aqueous liquid is sprayed over the dry hydraulic cement mix held stationary on the interior cylindrical surface thereby enabling utilization of the "false set" to hold the wet mixture in place during the curing process. Since the wet mix is not agitated after spraying with the aqueous setting liquid, the "false set" is not disturbed or broken which enables the production of a smooth and uniform cement coating without slumping or sagging.

Although advantage may be taken of the "false set" in the above-described Gunite method, it is still virtually impossible to achieve smooth and uniform coatings on interior cylindrical surfaces according to this method because of the above-noted phenomenon of "overcoating".

Although the method is applicable to the formation of hydraulic cement coatings on any type of hollow cylindrical surface, the invention is particularly suitable for forming cement coatings on the interior of metal pipes such as cast iron or steel pipes.

Any hydraulic cement composition may be utilized such as Portland Cement, calcium, aluminate, natural cement, mixtures thereof, etc. The process is particularly suited for the so-called "rapid-curing" type of "early" cements.

The rate of rotation of the cylindrical surface is critical to the practice of the invention. The relationship between the rate of rotation, the cylindrical diameter and the centrifugal force generated by the rate of rotation is defined by the formula:

$$g=(n^2\text{Dia.})/70{,}500$$

wherein g = units of acceleration due to gravity + to 32.5 ft. per sec. at standard condition, n = spinning speed of cylindrical surface in r.p.m., and Dia. = cylindrical diameter in inches.

The cylindrical surface is rotated at an r.p.m. sufficient to impart a force equivalent to at least 1 g force on the said cement composition. Whereas g forces equal to 1 are generally sufficient to hold the dry cement composition after being wetted by the aqueous composition, excess fluid or water will generally not be held stationary by a g force equal substantially to 1. Accordingly, as noted above it is unnecessary to rigorously control the amount of water applied to the dry cement coating. By utilizing a rate of rotation such that the g force is equal to about 1, the wetted cement composition will be held stationary on the pipe and the excess water will simply drain off from the coated surface. It will be obvious to those skilled in the art that the utilization of excessive rates of rotation will result in g forces substantially greater than 1 which will hold the excess water stationary as well as the cement composition. Moreover, excessive rotation rates will inhibit water penetration throughout the total thickness of the cement coating due to close packing of the cement composition particles. Such excessive rates of rotation are, of course, to be avoided.

Generally, water is sprayed or applied to the dry cement coating within the interior cylindrical surface by a "slinger" or conventional spraying apparatus.

Where it is desired to form an exceptionally smooth coating, only a portion of the cement composition is applied in the dry form to the interior cylindrical surface. The remainder of the cement composition, preferably containing a finer grade of sand filler or aggregate in order to achieve a smooth surface is mixed with excess water and applied to the dry coating in the same manner described above with respect to water. The excess water is extracted from the wet "mortar mix" by the dry cement coating. Excess water from the composite coating is then allowed to drain off thereby providing an exceptionally smooth cement coating surface.

Alternatively, the entire cement composition may be applied in a dry form and the coating sprayed with water as described above and the wet mix trowelled or otherwise mechanically treated to smooth the surface thereof.

The hydraulic cement composition applied to the interior cylindrical surface may contain a conventional filler or particulate aggregate such as sand, concrete formers such as crushed rock or gravel, etc.

Generally, it is desired to form cement-sand coatings on the interior surfaces of metal pipes. Generally, the weight ratio of cement to sand in the final coating is in the range of 1:1 to 1:2.

Where it is desired to form exceptionally smooth coatings, a coarse grade of sand may be utilized in the dry mix and a much finer sand employed in the "mortar mix" applied with excess water to the surface therof. This technique enables the utilization of less expensive coarse sand in the bulk of the coating and the utilization of the more expensive, finer sand in the surface portion of the coating to provide a smooth surface.

The invention is particularly suited for the formation of coatings involving the blending of two or more materials that react too quickly to permit water additions prior to the coating operation. For example, calcium aluminate cement reacts at an extremely fast rate with Portland Cement in the presence of water. Such composite calcium aluminate-Portland Cement coatings for pipes are extremely valuable. The present invention enables the admixture of the cement materials in the dry state and placing them in contact with the rotating pipe surface prior to the addition of water. Reaction occurs at the site of coating and the coating is hardened or cured immediately thereby avoiding the disadvantages associated with a prior wet mixing of the materials before coating.

The invention is further illustrated by the following non-limiting examples:

EXAMPLE

The following procedure was employed to coat ductile iron pipes according to the parameters and specifications set forth below:

I

Size: 17.4 Inches Outside Diameter; Wall Thickness 0.4 inch
Lining Material:
1 Part by weight Portland Cement Type II
1 Part by weight silica sand 36 mesh AFS number
Dry Lining Wt.: 12.5 lbs. per foot
Rotation: 5×g
Finishing Method: Trowelled; air jet to remove excess water
Retained Water: 11%
Retained Lining Thickness: 0.25 inch

II

Size: 17.4" OD; Wall Thickness 0.34"
Lining Material:
1 Part silica flour 200 mesh
1 Part silica sand 100 mesh
1 Part silica gravel 4 mesh
1 Part Portland Cement Type II
Dry Lining Wt.: 45 lbs. per foot
Rotation: 5×g
Finishing Method: Trowelled; air jet to remove excess water
Retained Water: 12%
Retained Lining Thickness: 0.9"

III

Size: 38.3" OD; Wall Thickness 0.53"
Lining Material:
1 Part silica sand 36 mesh
1 Part Portland Cement Type II
Dry Lining wt.: 25 lbs. per foot
Rotation: 8×g
Finishing Method: Trowelled; air jet to remove excess water
Retained Water: 10%
Retained Lining Thickness: 0.25"

The temperature of pipe, water and cement/sand were varied from 40° F. to 190° F. with little effect on the process except for a faster rate of water evaporation at higher temperatures.

I claim:

1. A method of coating the interior of a hollow cylindrical surface with a hydraulic cement comprising:

(a) depositing on the internal surface of said cylinder a composition comprising a substantially dry hydraulic cement, said cylinder being rotated about its longitudinal axis at a rate such that the centrifugal force generated thereby holds the cement composition substantially stationary at the point of deposition with respect to the said internal surface;

(b) applying to the said dry cement coated internal surface an aqueous composition containing an amount of water sufficient to substantially wet and harden said hydraulic cement; and (c) continuing to rotate said cylinder until the said hydraulic cement coating has substantially hardened.

2. The method of claim 1 wherein said hollow cylindrical surface is a pipe.

3. The method of claim 2 wherein said pipe surface is metallic.

4. The method of claim 3 wherein said pipe surface is iron.

5. The method of claim 3 wherein said pipe surface is steel.

6. The method of claim 1 wherein said hydraulic cement is Portland Cement.

7. The method of claim 1 wherein said hydraulic cement is calcium aluminate.

8. The method of claim 1 wherein said hydraulic cement comprises a mixture of Portland Cement and calcium aluminate.

9. The method of claim 1 wherein the relationship between the rate of rotation, cylindrical diameter and centrifugal force is defined by the formula:

$g=(n^2\text{Dia.})/70{,}500$ wherein g = units of acceleration due to gravity = to 32.5 ft. per sec. at standard conditions, n = spinning speed of cylindrical surface in r.p.m., and Dia. = cylindrical diameter in inches, and the cylindrical surface is rotated at an r.p.m. sufficient to impart a force equivalent to at least 1 g force on the said cement composition.

10. The method of claim 1 wherein said aqueous composition is water.

11. The method of claim 1 wherein said aqueous composition contains a portion of said cement composition.

12. The method of claim 11 wherein said dry hydraulic cement composition contains sand and the aqueous cement containing composition contains sand having a particle size smaller than that of the sand in the dry cement composition.

13. The method of claim 1 wherein hydraulic cement composition additionally contains a particulate aggregate.

14. The method of claim 13 wherein said aggregate is sand.

15. The method of claim 14 wherein the weight ratio of cement to sand is in the range from 1:1 to 1:2.

16. The method of claim 13 wherein said sand containing hydraulic cement composition additionally contains a concrete former.

17. The method of claim 16 wherein said concrete former is crushed rock or gravel.

18. The method of claim 1 including the step of troweling the said wetted cement composition to smooth the coating.

19. The method of claim 1 wherein the aqueous composition is applied to the dry cement composition by spraying.

* * * * *

UNITED STATES PATENT AND TRADEMARK OFFICE

CERTIFICATE OF CORRECTION

PATENT NO. : 4,298,634

DATED : November 3, 1981

INVENTOR(S) : Edwin H. Phelps

It is certified that error appears in the above-identified patent and that said Letters Patent are hereby corrected as shown below:

On the title page, Item [73]

Change "Assignee" from: Compagnie Internationale Pour I'Informatique CII-Honeywell Bull (Societe Anonyme), Paris, France to: American Cast Iron Pipe Company Birmingham, Alabama Signed and Sealed this Fourth Day of May 1982

[SEAL]

*Attest:*

GERALD J. MOSSINGHOFF

*Attesting Officer*

*Commissioner of Patents and Trademarks*